United States Patent [19]

Ondrasik, II

[11] 4,089,321

[45] May 16, 1978

[54] CONSTRAINING GRATE

[76] Inventor: Vladimir J. Ondrasik, II, 17044 Westbury Dr., Granada Hills, Calif. 91344

[21] Appl. No.: 655,889

[22] Filed: Feb. 6, 1976

[51] Int. Cl.[2] ..... F24C 15/10

[52] U.S. Cl. ..... 126/215

[58] Field of Search ..... 126/215, 214 C, 50, 126/221, 211, 39 R

[56] References Cited

U.S. PATENT DOCUMENTS

| | | | |
|---|---|---|---|
| 3,369,537 | 2/1968 | Young | 126/215 |
| 3,442,261 | 5/1969 | Berlin | 126/215 |
| 3,805,765 | 4/1974 | Hodae | 126/215 |

*Primary Examiner*—Edward G. Favors

*Attorney, Agent, or Firm*—John L. Haller

[57] ABSTRACT

An improved constraining grate adapted to alleviate vibration, rattle, and dislodgement of the improved constraining grate. This invention utilizes a circumferentially resilient structure with downward projections which are accepted by holes within the receiving unit and which are bound therein.

4 Claims, 11 Drawing Figures

CONSTRAINING GRATE

BACKGROUND OF THE INVENTION

1. Field of the Invention

This invention relates to an improved constraining grate which alleviates the tendency for standard grates to vibrate, rattle and become dislodged. Grates which are used to support articles over stove burners in stoves within various types of recreational vehicles are particularly susceptible to these problems. Various types of constraining mechanisms for the standard grates have been developed.

2. Description of Prior Art

The problem of unstable grates has existed for some time. The solution to this problem has been to develop various forms of external clips, which are used to secure the grate to a stove. U.S. Pat. No. 2,444,862, U.S. Pat. No. 3,170,457, U.S. Pat. No. 3,263,676, and U.S. Pat. No. 3,416,513 all describe grate-constraining devices which embody some form of external clip. The use of these external clips is generally undesirable because they are difficult to install, vibrate loose, and often get misplaced.

U.S. Pat. No. 2,571,741 discloses a grate and drip pan combination wherein the grate is "adapted to seat on the shoulder and to resiliently engage the angular wall of the drip pan so that the grate cannot shift with respect to the drip pan." However, the combination grate and drip pan, as disclosed, is generally unstable, and as a unit displays the type of undesirable characteristics which this invention is designed to overcome. Often on various stove grates a downward projection is included which is designed to prevent the grate from rotating while resting on the stove. The projection used in this manner, however, serves no function associated with securing the grate to the stove.

SUMMARY OF THE INVENTION

It is an object of this invention to provide an improved constraining grate which alleviates vibration, rattle, and dislodgement of the grate without the necessity of external clips.

The improved constraining grate incorporates a circumferentially resilient structural circumferential member and a means for support attached to the structural member which provides support for articles when placed thereon. The support means permit the compression of the structural member and provide a plurality of protrusions which extend outside the structural member, three of which have downward projections. A receiving unit has holes in it which are located to accept the projections when the improved constraining grate is installed. The improved constraining grate is installed by manually compressing the structural member and fitting the projections into the corresponding holes, then releasing the structural member wherein the projections are bound inside the holes, thus securing the improved grate to the receiving unit.

A further object of this invention is to provide an improved constraining grate which would be used over stove top burners on stoves within unstable environments such as any form of recreational vehicle.

A further object of this invention is to provide an improved constraining grate that is easily manufactured, inexpensive to fabricate, and easy to install.

A further object of this invention is to provide an improved constraining grate that can be adapted to most stove tops with only minor reconfiguration of the stove top required.

BRIEF DESCRIPTION OF THE DRAWINGS

The following is a brief descriptive of the accompanying drawings.

DESCRIPTION OF THE PREFERRED EMBODIMENT

Figure 1:
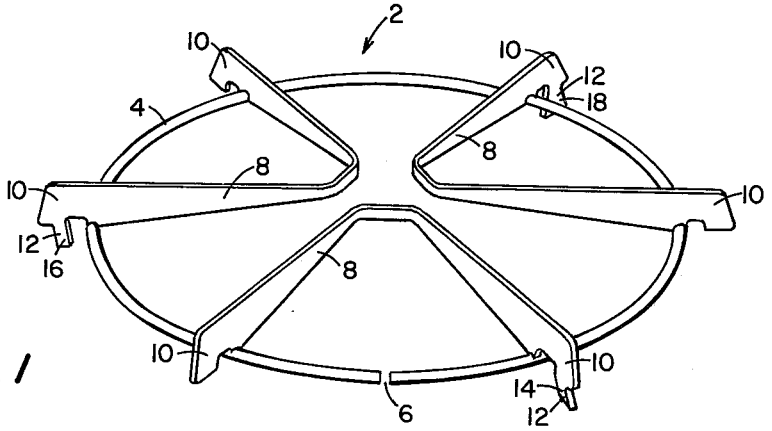
FIG. 1 is an oblique diagram of the constraining grate.
Figure 2:
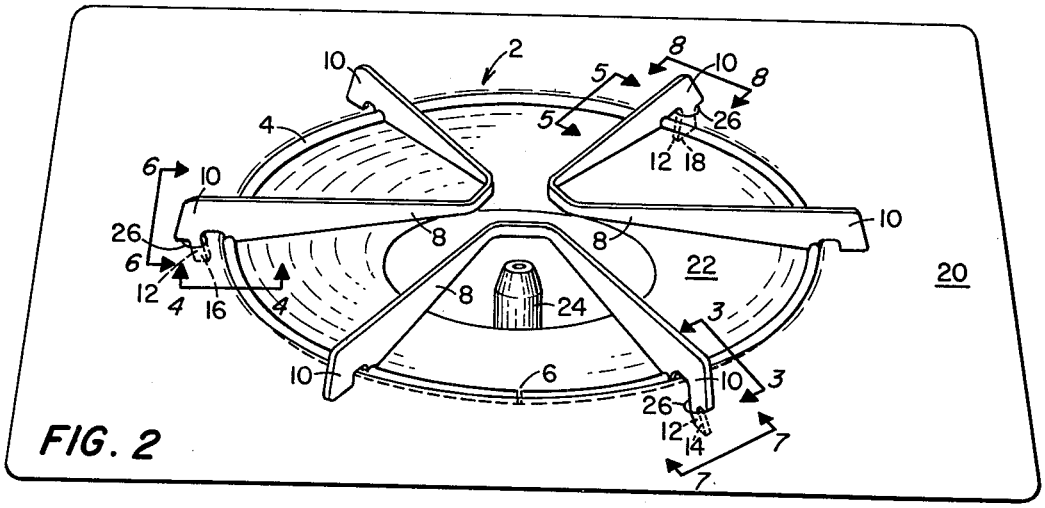
FIG. 2 is an oblique diagram of the constraining grate when installed over stove top burner.

As illustrated in FIG. 1, the improved constraining grate 2 embodies the same basic structure as commonly used grates. The improved constraining grate 2 provides a structural member 4 which is circumferentially resilient and fabricated such that a gap 6 is provided in the structural member 4 to permit circumferential compression of the structural member 4. A means for support is attached to the structural member 4 to provide support for articles placed thereon. The particular design of the support means is generally irrelevant except that the support means used must permit and may not prevent the circumferential compression of the structural member 4. As illustrated in the figures, "V" shaped support members 8, which are welded to the structural member 4, are quite suitable.

The support members 8 have a plurality of protrusions 10 distributed around the structural member 4 which extend outside the structural member 4. Three of the protrusions 10, which are themselves distributed around the structural member 4, have downward projections 12. The projection 12 closest to the gap 6 in the counterclockwise direction, as viewed from the top of the constraining grate 2, is the right projection 14. Similarly, the projection 12 closest to the gap 6 in the clockwise direction is the left projection 16. Finally, the remaining projection 12 is the opposite projection 18.

The constraining grate 2 operates in combination with a receiving unit such as a stove top 20. The stove top 20 is prepared with a depression 22, around a burner 24 which protrudes therethrough. The depression 22 is prepared such that the structural member 4 fits inside the depression 22 and the protrusions 10 rest on the stove top 20 outside the depression 22. The stove top 20 has three holes 26 in it distributed around the depression 22 such that the holes 26 will accept the projections 12 when the constraining grate 2 is installed.

Figure 3:
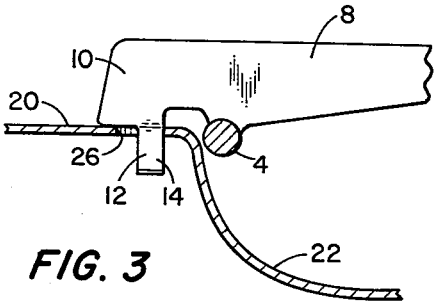
FIG. 3 is a vertical section of an installed constraining grate, substantially on line 3—3 of FIG. 2, showing a side view of the right projection.
Figure 7:
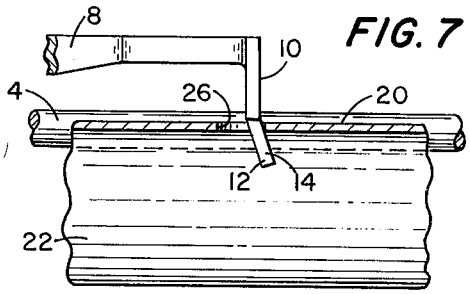
FIG. 7 is a vertical section of an installed constraining grate, substantially on line 7—7 of FIG. 2, showing a rear view of the right projection.
Figure 10:
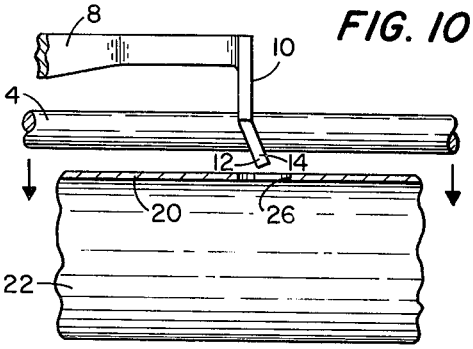
FIG. 10 is a vertical section of a constraining grate, substantially on line 7—7 of FIG. 2, showing a rear view of the right projection during installation.

FIG. 3, FIG. 7 and FIG. 10 illustrate the right projection 14. FIG. 3 shows that the right projection 14 has vertical inside and outside edges. FIG. 7 and FIG. 10 show that the lower portion of the right projection 14 is bent away from the gap 6 in a counterclockwise direction.

Figure 4:
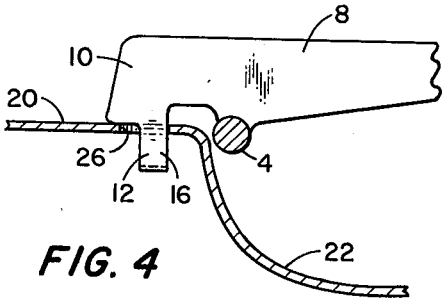
FIG. 4 is a vertical section of an installed constraining grate, substantially on line 4—4 of FIG. 2, showing a side view of the left projection.
Figure 6:
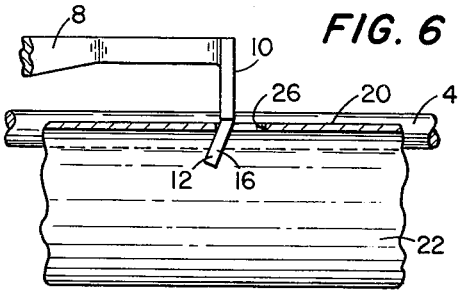
FIG. 6 is a vertical section of an installed constraining grate, substantially on line 6—6 of FIG. 2, showing a rear view of the left projection.
Figure 9:
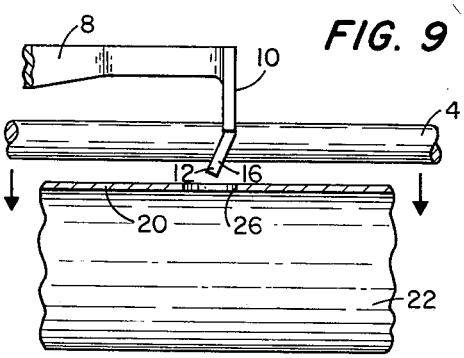
FIG. 9 is a vertical section of a constraining grate, substantially on line 6—6 of FIG. 2, showing a rear view of the left projection during installation.

FIG. 4, FIG. 6 and FIG. 9 illustrate the left projection 16. FIG. 4 shows that the left projection 16 has vertical inside and outside edges. FIG. 6 and FIG. 9 show that the lower portion of the left projection 16 is bent away from the gap 6 in a clockwise direction.

Figure 5:
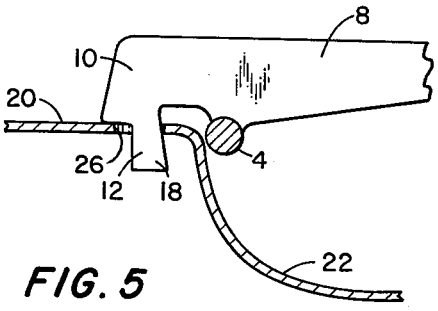
FIG. 5 is a vertical section of an installed constraining grate, substantially on line 5—5 of FIG. 2, showing a side view of the opposite projection.
Figure 8:
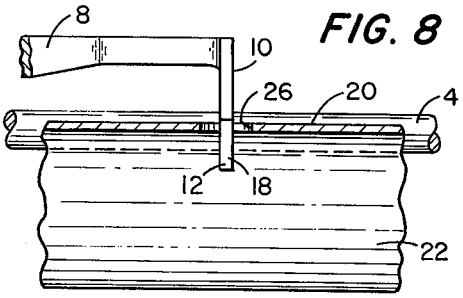
FIG. 8 is a vertical section of an installed constraining grate, substantially on line 8—8 of FIG. 2, showing a rear view of the opposite projection.
Figure 11:
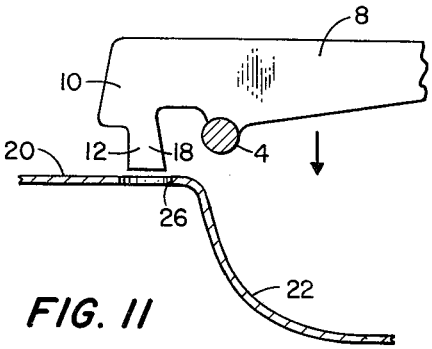
FIG. 11 is a vertical section of a constraining grate, substantially on line 5—5 of FIG. 2, showing a side view of the opposite projection during installation.

FIG. 5, FIG. 8 and FIG. 11 illustrate the opposite projection 18. FIG. 8 shows that the opposite projection 18 is vertical and not bent in either the clockwise or counterclockwise direction. FIG. 5 and FIG. 11 show that the opposite projection 18 has a vertical outside edge and that its inside edge is beveled, with the bottom portion of the projection wider than its top portion.

The constraining grate 2 is installed by first inserting the opposite projection 18 into the corresponding hole 26, as shown in FIG. 11. After the opposite projection 18 is inserted, the constraining grate 2 is pulled toward the gap 6 which wedges the lower portion of the opposite projection 18 under the edge of its receiving hole 26, as shown in FIG. 5. The structural member 4 is then circumferentially compressed, closing the gap 6 and permitting the left projection 16 and the right projection 14 to be simultaneously inserted into the corresponding holes 26 as shown in FIG. 9 and FIG. 10, respectively. After the left projection 16 and the right projection 14 are inserted, the structural member 4 is released and the resilient action of the structural member 4 opens the gap 6 and binds the left projection 16 and the right projection 14 under the edges of their receiving holes 26, as shown in FIG. 6 and FIG. 7, respectively.

While other specific variations of the concept could easily be developed, the precise structure described herein is considered best for fabricating the improved constraining grate. Specifically recognized as a variation of the constraining grate is one where the projections have no special construction and are merely vertical projections. While the variation using merely vertical projections satisfactorily meets the desired objectives, the first described structure is considered best.

Using the above description, those skilled in the particular art of grate fabrication could easily construct this constraining grate, or variant forms thereof. Such variant forms are to be considered within the scope and essence of this invention.

What is claimed is:

1. An improved constraining grate and receiving unit which comprises:

a. a resilient structural circumferential member;

b. a means for support attached to said structural member, said support means having at least three protrusions distributed around the extending outside of said structural member, three of said protrusions having downward projections said protrusions having downward projections being distributed around said structural member and said support means being adapted to hold articles placed thereon;

c. a means for compressing said structural member;

d. a receiving unit surface having three holes therein, each of said holes being paired with one of said protrusions having downward projections, and said holes being positioned to accept said projections when said structural member is circumferentially compressed, and to bind said projections within said holes when said compression is released.

2. An improved constraining grate and receiving unit, as recited in claim 1, wherein said compressing means is a gap within said structural member, whereby said structural member may be circumferentially compressed.

3. An improved constraining grate and receiving unit, as recited in claim 2, wherein the lower portion of the downward projection closest the gap in the clockwise direction is bent slightly in the clockwise direction away from the gap, and wherein the lower portion of the downward projection closest the gap in the counterclockwise direction is bent slightly in the counter-clockwise direction away from the gap, and wherein the inside edge of the lower portion of the downward projection most nearly opposite the gap is bevelled inward such that the bottom portion is wider than the upper portion, and wherein the lower portion of all projections are bound under the edges of the respective holes when the constraining grate is installed.

4. An improved constraining grate, and receiving unit, as recited in claim 1, wherein said structural member is circular and made of basic common wire.

* * * * *